US005349314A

United States Patent [19]

Shimizu et al.

[11] Patent Number: 5,349,314

[45] Date of Patent: Sep. 20, 1994

[54] STRIPLINE FILTER DEVICE HAVING A COUPLING DIELECTRIC LAYER BETWEEN TWO STRIPLINE RESONATORS

[75] Inventors: Hiroyuki Shimizu; Kenji Ito, both of Nagoya, Japan

[73] Assignee: NGK Spark Plug Co., Ltd., Aichi, Japan

[21] Appl. No.: 51,767

[22] Filed: Apr. 26, 1993

[30] Foreign Application Priority Data

Apr. 30, 1992 [JP] Japan ..... 4-139864

[51] Int. Cl.[5] ..... H01P 1/203

[52] U.S. Cl. ..... 333/204; 333/205

[58] Field of Search ..... 333/202–205, 333/219, 246, 116

[56] References Cited

U.S. PATENT DOCUMENTS 4,157,517 6/1979 Kneisel et al. ..... 333/205
4,701,727 10/1987 Wong ..... 333/204

FOREIGN PATENT DOCUMENTS 61-100002 9/1986 Japan .
61-201501 1/1987 Japan .
0297901 12/1989 Japan ..... 333/204
0305701 12/1989 Japan ..... 333/204

*Primary Examiner*—Seungsook Ham
*Attorney, Agent, or Firm*—Larson and Taylor

[57] ABSTRACT

A stripline filter device including two or more dielectric substrate assemblies each having a pair of superimposed dielectric substrates between which at least one resonator conductor is disposed, wherein the dielectric substrate assemblies are stacked with an intermediate dielectric layer being sandwiched between the adjacent substrate assemblies so as to couple the resonator conductors in a direction perpendicular to the plane of each substrate, and by suitably setting the material and/or the thickness of each intermediate dielectric layer the coupling quantity between the resonators can be adjusted to obtain a desired frequency bandwidth.

4 Claims, 3 Drawing Sheets

STRIPLINE FILTER DEVICE HAVING A COUPLING DIELECTRIC LAYER BETWEEN TWO STRIPLINE RESONATORS

BACKGROUND OF THE INVENTION

The present invention relates to a stripline filter device with means for adjusting a coupling quantity between pairs of dielectric substrates.

Such a stripline filter device is known, which is used as a band-pass filter for a microwave range. The stripline filter is becoming watched because it is easily made thinner or smaller than block type filters and suitable for meeting a requirement for a size reduction of potable communication equipments such as potable telephones.

An example of such a conventional stripline filter device is illustrated in FIG. 1. As will be seen in FIG. 1, a plurality of stripline resonator conducting layers A are disposed in an interdigitated form on a dielectric substrate B whose outer surface is provided with a ground conductor layer C with which one end of each resonator conducting layer A is connected. An example of such a stripline filter is disclosed in U.S. Pat. No. 4,157,517.

With this conventional stripline filter device, if the distance W between the adjacent resonator conducting layers A and A on the dielectric substrate B is too small, a coupling therebetween becomes strong to give too large resonance bandwidth. If the distance W between the adjacent resonator conducting layers A and A is set to a larger size so as to obtain a desired resonance bandwidth, the filter completed increases in size. In order to overcome this problem it has been proposed to provide a groove between the adjacent resonator conducting layers for forming a gap therebetween which decreases the quantity of the coupling. In this connection, for example, Japanese Patent Kokai Nos. 61-100002 and 61-201501 are referred. However, this method has a disadvantage that troublesome machining is required.

SUMMARY OF THE INVENTION

It is therefore an object of the present invention to provide a small size stripline filter device capable of overcoming the problems or disadvantages of the conventional stripline filter arrangements, in which a coupling quantity can be easily adjusted.

According to the present invention, there is provided a stripline filter device which comprises at least two dielectric substrate assemblies intended to be stacked to each other, each dielectric substrate assembly including a pair of superimposed dielectric substrates, at least one stripline resonator of a predetermined pattern interposed between the paired substrates and a ground conductor provided at least on the main portion of outer surfaces other than the surfaces on which said stripline resonator is arranged, and an intermediate dielectric layer having a dielectric constant smaller than that of each dielectric substrate, which is interposed between the dielectric substrate assemblies for adjusting a coupling quantity between the stripline resonators in the stacked dielectric substrate assemblies.

Preferably, the intermediate dielectric layer may be provided with a connecting ground conductor by which the ground conductors of said stacked substrate assemblies are connected to each other.

The thickness and/or material of the intermediate dielectric layer may be determined so that a desired coupling quantity is obtained.

The stripline resonators interposed between the respective paired dielectric substrates are coupled with each other in a stacked direction so that a required filtering function is obtained. By the provision of the intermediate dielectric layer having a dielectric constant smaller than that of each dielectric substrate between the adjacent dielectric substrate assemblies, the quantity of coupling between the stripline resonators of the different paired dielectric substrates is reduced to provide a desired narrow frequency band. It is, therefore, possible to suitably adjust the magnetic coupling between the stripline resonators by selecting the dielectric constant and/or the thickness of each intermediate dielectric layer.

The present invention will now be described by way of example with reference to the accompanying drawings:

DETAILED DESCRIPTION

Figure 2:
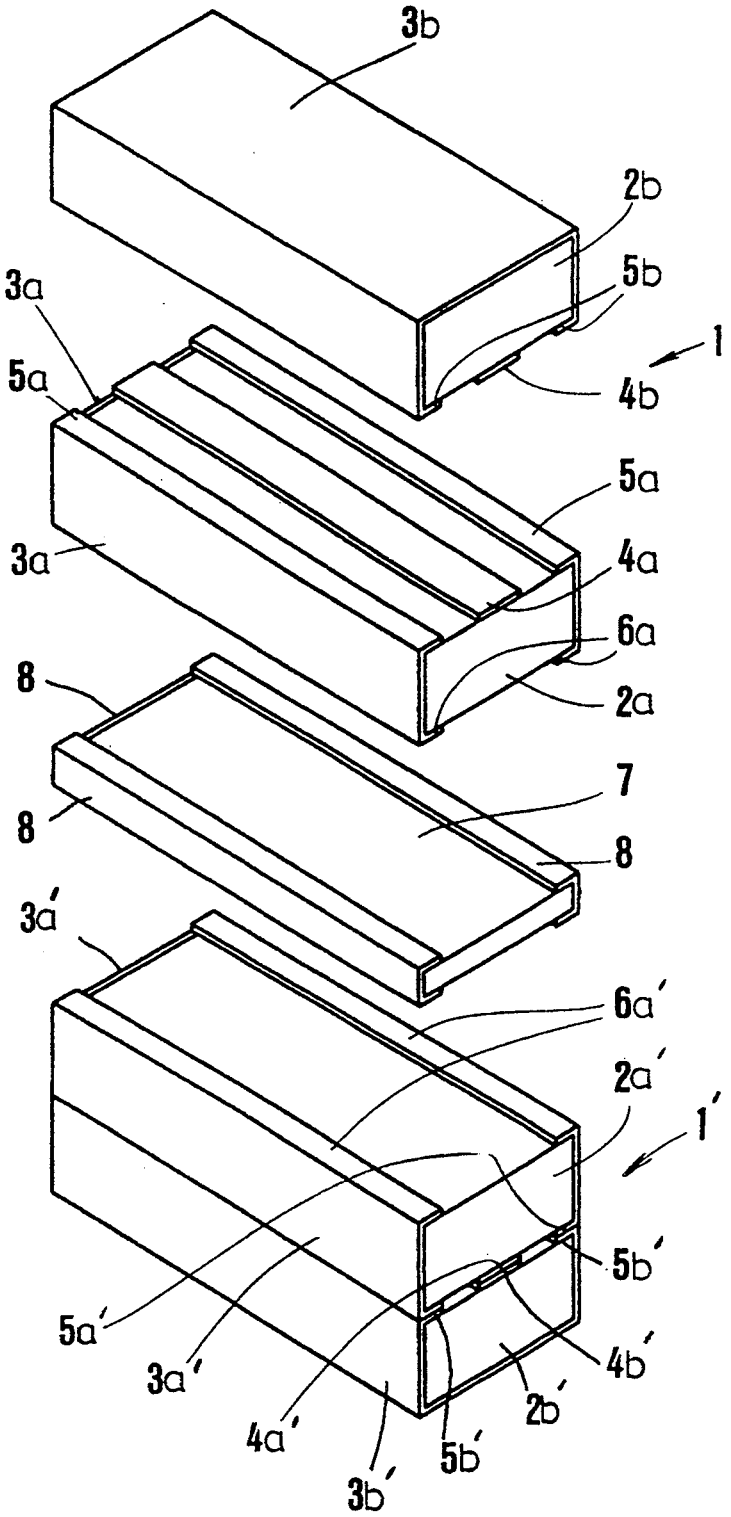
FIG. 2 is an exploded perspective view of a stripline filter device according to the present invention.
Figure 3:
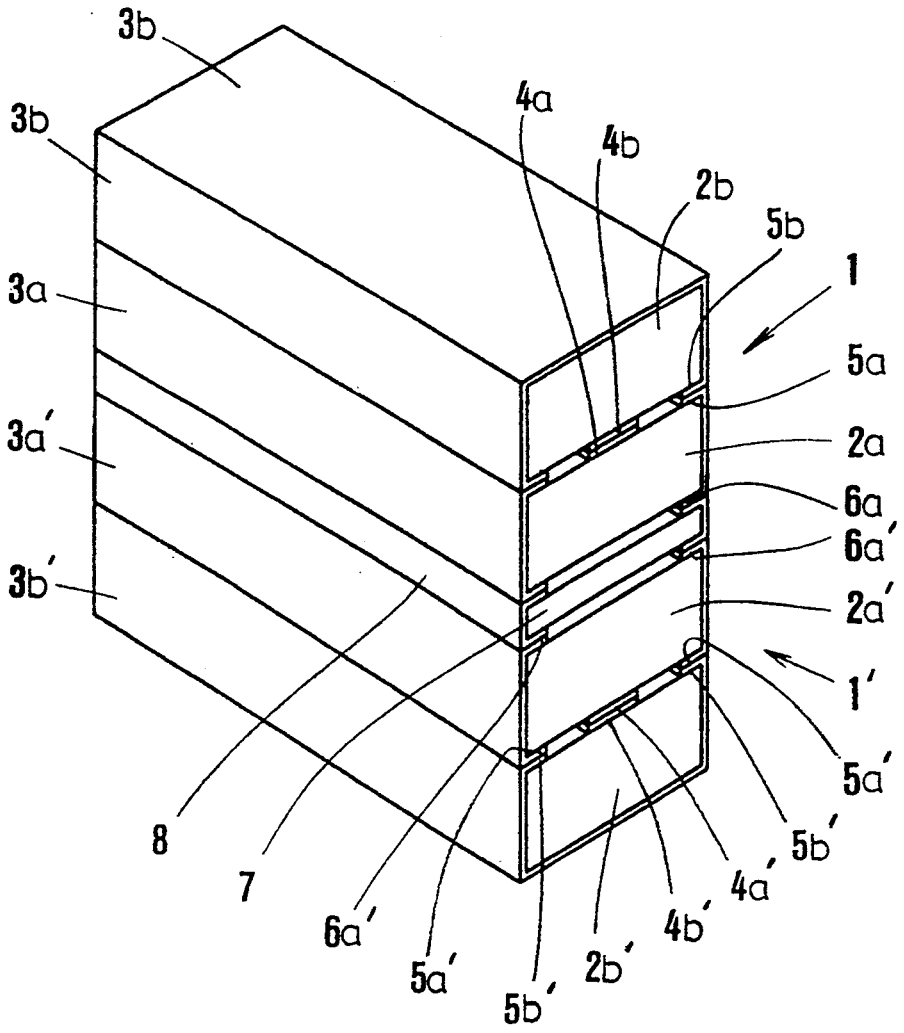
FIG. 3 is a schematic perspective view showing the stripline filter device of FIG. 2 when being assembled.

Referring to FIGS. 2 and 3, there is shown a stripline filter device according to an embodiment of the present invention. The illustrated stripline filter device comprises two dielectric substrate assemblies 1 and 1'. For convenience, the similar elements of assembly 1' will not be discussed separately and instead will be identified with the same numerals as used with assembly 1, but with a prime (') added thereto. Assembly 1 includes a pair of dielectric substrates **2*a* and 2*b*. The dielectric substrate 2*a* is provided with a ground conductor 3*a* on both lateral surfaces and rear surface except the front surface thereof. The dielectric substrate 2*b* is provided with a ground conductor 3*b*** on the outer surface thereof which is exposed to the atmosphere when being assembled except the front surface thereof.

On the surfaces of the dielectric substrates **2*a* and 2*b* to be superimposed to each other there are respectively arranged stripline resonance conductors 4*a* and 4*b* each having a predetermined pattern, which are positioned to be integrated to form a resonator when the dielectric substrates 2*a* and 2*b* are superimposed. Rear ends of the resonance conductors 4*a* and 4*b* are connected with the ground conductors 3*a* and 3*b* to form short-circuit terminals, respectively, while front ends of the resonance conductors 4*a* and 4*b* are extended toward the front edge of the respective substrates to form open-circuit terminals, respectively. Also, the ground conductors 3*a* and 3*b* are extended to both lateral edge portions on the surfaces to be superimposed of the dialectic substrates 2*a* and 2*b* so as to form connecting edge conductors 5*a* and 5*b*, respectively. The ground conductor 3*a* is also extended to both lateral edge portions on the opposite surface of the dielectric substrate 2*a* so as to form connecting edge conductors 6*a***.

For example, the resonator (**4*a* and 4*b*) in one substrate assembly 1 is connected with an input or output terminal (not shown) via a connecting capacitor not shown, while the resonator (4*a'* and 4*b'***) in the other substrate assembly 1' is connected with an output or input terminal (not shown) via a connecting capacitor not shown.

Figure 1:
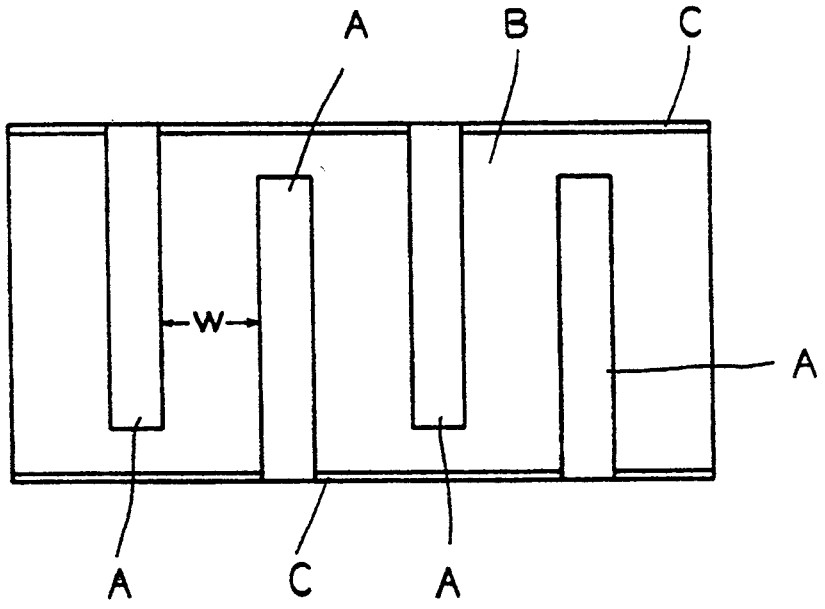
FIG. 1 PRIOR ART
FIG. 1 is a plan view showing a conventional stripline filter device.

In FIGS. 1 and 2, reference numeral 7 denotes an intermediate dielectric layer for reducing the coupling quantity between the resonators in the substrate assemblies 1 and 1'. This dielectric layer 7 is made of dielectric material having a dielectric constant smaller than that of each substrate 2a or 2b and as shown in FIG. 1 is provided with ground conductors 8 which is formed on both the lateral edge portions of the dielectric layer 7.

When being assembled the dielectric layer 7 is sandwiched between the substrate assemblies 1 and 1' and the ground conductors 3a' and 3b in one substrate assembly 1 is electrically connected with the ground conductors 3a and 3b' in the other substrate assembly 1' by means of the ground conductor 8 in the sandwiched dielectric layer 7.

The substate assemblies 1 and 1' are assembled by sandwiching the intermediate dielectric layer 7 therebetween, and then is integrally sintered. For this end, it is desirable that each dielectric substrate and the intermediate dielectric layer may be made of dielectric material which can be sintered at the same temperature. For example, the substrates 2a and 2b may be made of $BaO—Nd_2O_3—TiO_2—Bi_2O_3$ having a dielectric constant of 90, and the intermediate dielectric layer 7 may be made of dielectric material having a dielectric constant of about 5–50 which is obtained by mixing Mg, Ca, Ba, Ti or the like into the material used for each substrate. In this connection, alternatively or additionally the magnetic coupling quantity can be adjusted by properly setting a thickness of the intermediate dielectric layer 7.

Instead of sintering the substrate assemblies 1 and 1' and the intermediate layer 7 may be combined with each other by using cream solder or the like after forming the ground conductors, the connecting conductors and the resonance conductors thereon.

With the arrangement mentioned above, the resonator conductors in the substrate assemblies 1 and 1' are coupled in a stacked direction and it is possible to perform an adjustment in such a direction that the coupling is obstructed by the intermediate dielectric layer 7, thereby securing a predetermined coupling quantity and a required frequency bandwidth characteristic.

In the illustrated embodiment the filter device comprises two dielectric substrate assemblies. However, three or more dielectric substrate assemblies may used to construct a filter device. Also, no ground conductor may be formed on each of the surfaces to be superimposed of the adjacent substrate assemblies. Alternatively, when each substrate assembly is prepared, the ground conductor previously formed on the surface of each substrate which is to be abutted on the dielectric layer may be removed.

Furthermore, the illustrated arrangement may be modified by using an interdigitated or comb type stripline resonator.

As described above, according to the present invention two or more dielectric substrate assemblies each having a pair of superimposed dielectric substrates between which at least one resonator conductor is disposed are stacked with an intermediate dielectric layer sandwiched between the adjacent substrate assemblies so as to couple the resonator conductors in a direction perpendicular to the plane of each substrate. Therefore, by suitably setting the material and/or the thickness of each intermediate dielectric layer the coupling quantity between the resonators can be adjusted to obtain a desired frequency bandwidth.

As compared with the conventional arrangement in which a groove is formed between the resonators for adjusting a frequency response, the filter device according to the present invention can be easily manufactured, and also permits the distance between the resonator conductors to be reduced by selecting of the material and/or thickness of the intermediate dielectric layer. Therefore, the present invention can provide a stripline filter device having a thickness which can reduce as thin as possible and can fully meet for the requirement of size reduction for potable communication equipments such as portable telephones.

It is to be understood that the above-mentioned embodiments are only illustrative of the application of the principles of the present invention. Numerous modifications and alterations may be made by those skilled in the art without departing from the spirit and scope of the invention, and the appended claims are intended to cover such modifications and alterations.

We claim:

1. A stripline filter device comprising at least two dielectric substrate assemblies stacked to each other, each dielectric substrate assembly including:

a pair of superimposed dielectric substrates, the substrates being superimposed at facing surfaces thereof and each substrate also including outer surfaces different from the associated facing surface, at least one stripline resonator of a predetermined pattern interposed between the facing surfaces of the paired substrates, a ground conductor provided at least on the outer surfaces of each dielectric substrate, and an intermediate dielectric layer having a dielectric constant smaller than that of each of the dielectric substrates, the intermediate dielectric layer being interposed between the dielectric substrate assemblies for adjusting a coupling quantity between the stripline resonators in the stacked dielectric substrate assemblies.

2. A stripline filter device as claimed in claim 1, wherein said intermediate dielectric layer is provided with a connecting ground conductor by which the ground conductors of said stacked substrate assemblies are connected to each other.

3. A stripline filter device as claimed in claim 1, wherein said intermediate dielectric layer has a thickness determined so that a desired coupling quantity is obtained.

4. A stripline filter device as claimed in claim 1, wherein said intermediate dielectric layer is made of dielectric material having a dielectric constant determined so that a desired coupling quantity is obtained.

* * * * *